US006739377B2

(12) United States Patent
Rueckert et al.

(10) Patent No.: US 6,739,377 B2
(45) Date of Patent: May 25, 2004

(54) PROCESS FOR INCORPORATING A METALLIC SEMI-FINISHED PRODUCT BY CASTING

(75) Inventors: Franz Rueckert, Ostfildern (DE); Helmut Schaefer, Kernen (DE); Dezsoe Schilling, Hemmingen (DE); Peter Stocker, Sulzbach (DE)

(73) Assignee: DaimlerChrysler AG, Stuttgart (DE)

( * ) Notice: Subject to any disclaimer, the term of this patent is extended or adjusted under 35 U.S.C. 154(b) by 11 days.

(21) Appl. No.: 10/285,123

(22) Filed: Oct. 31, 2002

(65) Prior Publication Data

US 2003/0079852 A1 May 1, 2003

(30) Foreign Application Priority Data

Oct. 31, 2001 (DE) ..... 101 53 305

(51) Int. Cl.[7] ..... B22D 19/00
(52) U.S. Cl. ..... 164/100; 164/91; 164/94
(58) Field of Search ..... 164/100, 91, 94

(56) References Cited

U.S. PATENT DOCUMENTS

| | | | | |
|---|---|---|---|---|
| 5,992,763 A | * | 11/1999 | Smith et al. | 239/428.5 |
| 6,132,293 A | * | 10/2000 | Littecke et al. | 451/38 |
| 6,286,583 B1 | * | 9/2001 | Rueckert et al. | 164/100 |

FOREIGN PATENT DOCUMENTS

| | | |
|---|---|---|
| DE | 40 32 862 | 4/1992 |
| DE | 41 43 103 | 7/1992 |
| DE | 195 29 749 | 2/1997 |
| DE | 196 34 636 | 4/1998 |
| DE | 197 50 687 | 5/1999 |
| DE | 199 35 164 | 2/2000 |
| DE | 100 14 486 | 10/2001 |
| EP | 0 568 315 | 11/1993 |
| EP | 0 750 054 | 12/1996 |
| EP | 0 826 444 | 3/1998 |
| FR | 2 758 284 | 7/1998 |

OTHER PUBLICATIONS

W.D. Schulz, "Einfluβ der Oberflächenvorbereitung/–vorbehandlung von Aluminium, Zink und anderen Werkstoffen auf die Beschichtung" (The Influence of Surface Preparation/Pretreatment of Aluminum, Zinc and Other Materials on Coatings), Galvanotechnik, 90 (1999) pp. 387–388.

* cited by examiner

*Primary Examiner*—Kiley Stoner
*Assistant Examiner*—I.-H. Lin
(74) *Attorney, Agent, or Firm*—Kenyon & Kenyon

(57) ABSTRACT

In a process for casting a metallic semi-finished product into a casting, the semi-finished product is roughened on a surface which faces the casting, then being placed in a defined position in a casting mold and surrounded with casting metal, after which a firm bond is formed between the semi-finished product and the solidified casting metal at the roughened surface. The surface of the semi-finished product is roughened by high-pressure water blasting.

6 Claims, 1 Drawing Sheet

PROCESS FOR INCORPORATING A METALLIC SEMI-FINISHED PRODUCT BY CASTING

CROSS-REFERENCE TO RELATED APPLICATIONS

The present application claims priority to application Ser. No. 101 53 305.5, filed in the Federal Republic of Germany on Oct. 31, 2001, which is expressly incorporated herein in its entirety by reference thereto.

FIELD OF THE INVENTION

The present invention relates to a process for casting a metallic semi-finished product into a casting.

BACKGROUND INFORMATION

Castings, in particular light-metal castings, are often reinforced by inserts which are integrated into the component by being cast in. These inserts form local improvements to the material, for example an improved resistance to wear, a higher mechanical strength or thermal stability.

The technical difficulty involved in incorporating inserts of this type by casting often resides in the unsatisfactory adhesion between the relatively smooth surface of the insert and the solidified casting metal. The brief contact time between the metallic melt and the insert and the poor wetting which exists in various material pairings in most cases prevents chemical bonding or alloying between the casting metal and the insert at their adjoining surfaces. A gap at the adjoining surface may impair heat transfer or form a mechanical weak point.

This problem is currently combated by roughening the surface of the insert. The roughening is sometimes carried out by sand-blasting or, as described in German Published Patent Application No. 197 50 687 with reference to the example of a cylinder liner, by material-removing machining of the surface followed by sand-blasting. As a result, microscopic undercuts are produced at the surface of the semi-finished product and lead to a clamping fit between the casting metal and the insert.

However, pure sand-blasting does not lead to desired undercuts, but rather substantially leads to recesses on the surface. The process described in German Published Patent Application No. 197 50 687 does produce the desired undercuts, but is overall very expensive.

It is an object of the present invention to improve the bonding of inserts in accordance with the prior art and of making this process less expensive.

SUMMARY

The above and other beneficial objects of the present invention are achieved by providing a process as described herein.

The process according to the present invention includes an insert being roughened by high-pressure water blasting before it is inserted into a casting mold. The high-pressure water blasting cleans the surface and produces undercuts on the surface of the insert, leading to, e.g., good securing of the casting metal after it has solidified.

The insert may be a metallic insert. Under certain conditions and with certain surface properties, it is also possible to use intermetallic components, hard metal, metal-ceramic composites, metal matrix composites (MMC), intermetallic ceramic composites, ceramics, natural inorganic materials, etc. as inserts.

It has been found that the optimum pressure range for a water jet may be between 1500 bar and 2000 bar. Above 2000 bar the surface may be damaged excessively, while below 1500 bar the formation of undercuts may be insufficient. Moreover, for these relatively low pressures it is possible to use pumps of existing pressure installations, such as, for example, for component deburring, with the result that the investment costs may be reduced.

The roughening of the surface may be performed by one or more fan-jet nozzles with an elliptical opening. Unlike full-jet nozzles with a circular opening, fan-jet nozzles provide a surface jet which widens and a groove-free surface. The use of a plurality of nozzles at the same time may reduce the machining time.

To achieve a particularly groove-free surface, an outlet angle of the high-pressure water jet may be between 20 and 34°.

An example manner of roughening the surface economically and quickly may be to use an array of nozzles, which may be arranged perpendicular to the surface.

Hypereutectic aluminum-silicon alloys may be particularly suitable for roughening the surface using the process according to the present invention. At the surface, semi-finished products made from materials of this type may have hard silicon-rich phases and relatively soft aluminum-rich phases. The hard, silicon-rich phases are torn out by the water-blasting and leave behind the desired undercuts at the surface.

The following explains the process according to the present invention in more detail with reference to an example and two figures.

DETAILED DESCRIPTION

EXAMPLE

Figure 1:
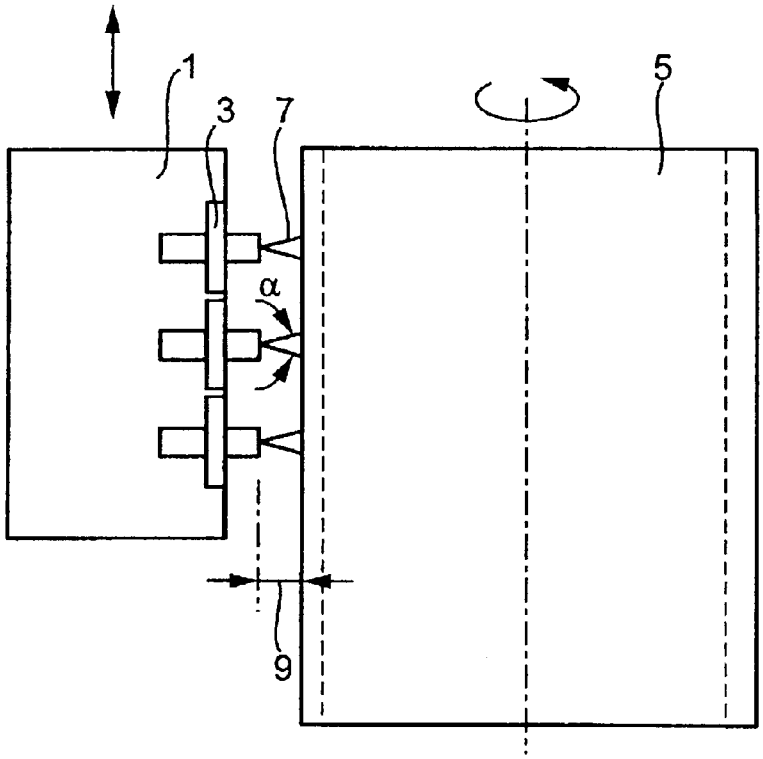
FIG. 1 illustrates an arrangement of three water-jet nozzles and a semi-finished product.

An array 1 of three fan-jet nozzles 3—as illustrated in FIG. 1—with elliptical openings with a diameter of 2.5 mm is positioned perpendicular to a rotating cylinder liner 5 made from a hypereutectic aluminum-silicon alloy. The distance 9 between nozzle opening and the cylinder liner 5 is 12 mm. The rotational speed of the cylinder liner 5 is 600 revolutions per minute. The nozzle array 1 describes a longitudinal movement along the longitudinal axis of the cylinder liner at a speed of 10 mm/s.

Figure 2:
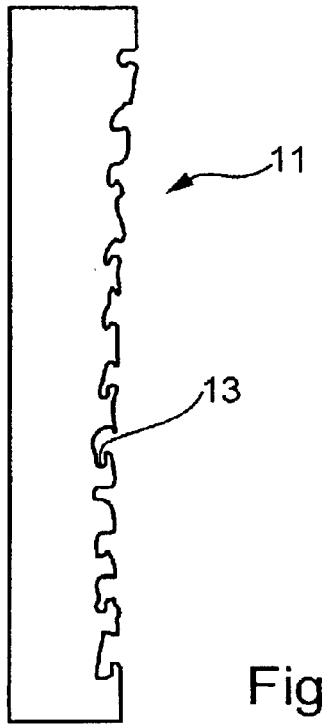
FIG. 2 illustrates a section through a water-blasted surface.

The blasting medium water contains a neutral cleaning agent in a concentration of approximately 1.5%. The blasting medium emerges from the nozzle 3 in the form of a water jet 7 describing an included angle a of 30°. When it emerges from the nozzle opening, the water jet 7 is at a pressure of 1900 bar. The water jet produces a surface 11 as illustrated in FIG. 2. The surface 11 has undercuts 13 which are produced as a result of silicon-rich phases being broken off. The roughness average Ra of the surface produced in this way is 8.4 $\mu$m, and the mean roughness depth Rz is 55.3 $\mu$m.

The cylinder liner which has been pretreated in this manner is positioned on center sleeves in a pressure die-casting die, the die is closed and a die cavity formed in this manner, which represents the outline of a cylinder crankcase, is filled under pressure (approximately 800 bar) with a liquid aluminum alloy (AlSi9Cu3). During the filling, the aluminum flows around the cylinder liner and penetrates into the regions of the undercuts 13. After the aluminum has solidified, the solidified aluminum is firmly secured to the surface of the cylinder liner (boundary surface). The bonding strength of this boundary surface is twice as high as that of a boundary surface with a sand-blasted surface of the insert.

Unlike in other blasting processes, the use of this process on aluminum-rich surfaces removes an adsorption layer and an oxide layer which forms as a result of the high oxygen affinity. The process according to the present invention creates a highly active surface on the semi-finished product with regard to the partial melting of the surface and a resulting metallic bonding.

The process according to the present invention may be used for all conventional casting processes in which inserts may be incorporated. These include, e.g., conventional pressure die-casting, squeeze casting, thixocasting, thixomoulding, gravity die casting, sand casting, precision casting, given suitably heat-resistant inserts, all types of iron casting, etc.

The parameters listed in the previous example are optimized for a specific application. The parameters may vary as follows, depending on the particular application. The distance between the nozzle opening and the surface of the insert may be between 10 mm and 30 mm. The pressure of the water jet may be between 1500 bar and 2000 bar, the outlet angle may be between 25° and 34°. The rotational speed of the insert may be between 100 and 1000/min, the speed of advance of the nozzle or of the array of nozzles varying between, e.g., 2 mm/s and 50 mm/s.

The two lesser parameters may be particularly important for the condition of the surface, namely, the shape and frequency of the undercuts, the microscopic surface roughness and the macroscopic flatness (avoidance of the formation of grooves). If inserts which are not rotationally symmetrical are used, the insert is not made to rotate during the water blasting.

The nozzle array or the individual nozzle entails thick supply lines, which are difficult to move, in conventional high-pressure water blasting installations. Accordingly, the free movement of the nozzles is limited. In many cases, it may be possible for the insert which is to be blasted to be moved relative to the nozzle array or to the nozzle. In a simple case, this is effected, as described in the example embodiment, by rotation. In other cases, the relative movement is produced by a suitable program or by robots.

What is claimed is.:

1. A process for casting a semi-finished product into a casting, comprising the steps of:

roughening the semi-finished product on a surface that faces the casting by high-pressure water blasting;

after the roughening step, placing the semi-finished product in a defined position in a casting mold and surrounding the semi-finished product with a casting metal; and forming a firm bond between the semi-finished product and solidified casting metal at the roughened surface.

2. The process according to claim 1, wherein water pressure of the water blasting is between 1500 bar and 2000 bar.

3. The process according to claim 1, wherein the water blasting is performed with at least one nozzle having an elliptical opening.

4. The process according to claim 1, wherein an outlet angle of a water jet from at least one nozzle is between 25° and 34°.

5. The process according to claims 1, wherein the water blasting is performed by an array of at least two nozzles directed perpendicular to the surface.

6. The process according to claim 1, wherein the semi-finished product includes a hypereutectic-aluminum alloy.

* * * * *